United States Patent [19]

Weindel

[11] 4,247,111

[45] Jan. 27, 1981

[54] GAME DEVICE

[76] Inventor: David P. Weindel, 1010 Frenchtown Rd., East Greenwich, R.I. 02818

[21] Appl. No.: 21,355

[22] Filed: Mar. 19, 1979

[51] Int. Cl.[3] ..... A63F 3/00; A63F 9/00

[52] U.S. Cl. ..... 273/148 R; 235/118

[58] Field of Search ..... 273/289, 148 R; 40/493, 40/503, 506; 235/61 B, 76, 87 R, 127, 118, 119; 74/129

[56] References Cited

U.S. PATENT DOCUMENTS

| | | | |
|---|---|---|---|
| 746,570 | 12/1903 | Pidgin | 235/118 |
| 988,275 | 3/1911 | McClave | 74/129 |
| 2,667,810 | 2/1954 | Javos | 74/129 |
| 3,467,382 | 9/1969 | Leadley | 273/148 R |

*Primary Examiner*—Richard C. Pinkham
*Assistant Examiner*—R. Carl Moy
*Attorney, Agent, or Firm*—Barlow & Barlow

[57] ABSTRACT

A game device having a plurality of insignia, a selective one of which may be exhibited at a time and the selected insignia may be changed by relative reciprocation of two of the members of the device.

4 Claims, 5 Drawing Figures

GAME DEVICE

BACKGROUND OF THE INVENTION

Devices which have reciprocating parts to vary indicia or insignia have heretofore been provided in a more or less complicated construction such as shown in the U.S. Pat. No. 3,177,595.

SUMMARY OF THE INVENTION

A base and sleeve telescopically slidable one relative to the other are provided in the sleeve of which there is an indicator rotatably mounted and some means to rotate that indicator a portion of a revolution upon movement of the sleeve in one direction of a reciprocating movement and to move the indicator further in the same direction upon the opposite reciprocating movement of the sleeve. This is accomplished by a ratchet with a blunt-ended pawl to engage the ratchet for moving it in one direction and a hooked pawl for moving the ratchet upon relative movement in the other direction. A spring is utilized for moving the base and sleeve in one direction, whereas the relative movement in the other direction is by manual manipulation.

DESCRIPTION OF THE PREFERRED EMBODIMENT

Figure 1:
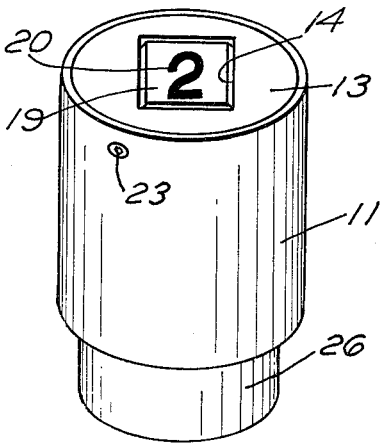
FIG. 1 is a perspective view of the game device with the sleeve moved under action of a spring to the end of its stroke in one direction.
Figure 2:
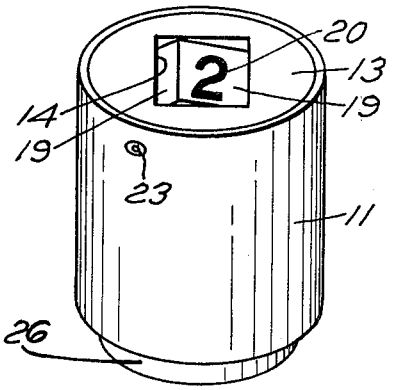
FIG. 2 is a perspective view of the device as shown in FIG. 1 where the sleeve is moved in the other direction to the limit of its stroke.

As shown in FIGS. 1 and 2, there is a base unit 25 (FIG. 3) with a cylindrical portion 26 and a sleeve 11 which may be reciprocated with reference to this base.

Figure 3:
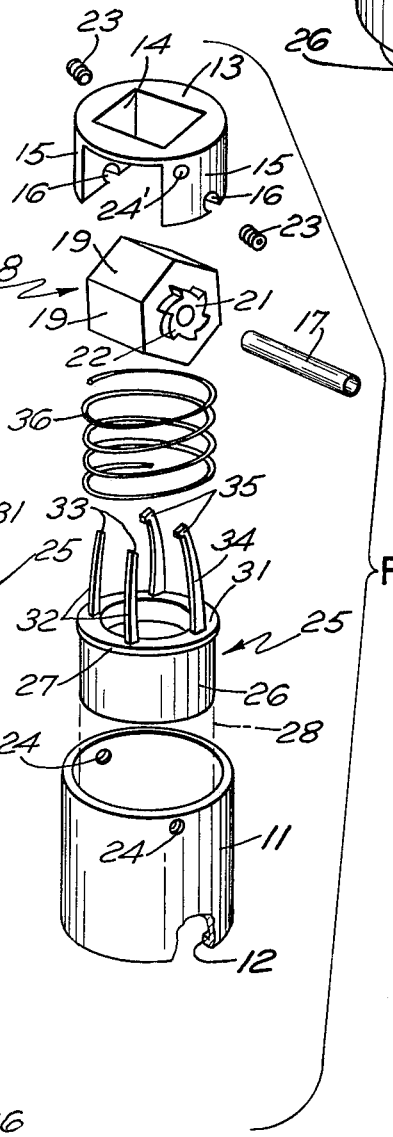
FIG. 3 is an exploded view with the various parts in perspective and in somewhat the relation they bear one with the other.

Referring to FIG. 3, the sleeve 11 is tubular and has an inturned flange 12 at its lower end. At the upper end of this sleeve there is a top wall 13 having a window opening 14 therein. This top wall has downwardly extending flanges 15 on either side thereof provided with aligned openings 16 for the reception of a shaft or pin 17 upon which an indicator designated generally 18 is freely rotatably mounted. Pin 17 may be fixed in indicator 18 and rotate in openings 16 as bearings. This indicator carries on its faces 19 which are shown as six in number although these may be varied, and upon each of these faces there is some insignia 20 shown as a numeral 2, while the other faces may have other insignia appropriate to the game device. Affixed to both sides of this rotatable indicator is a ratchet wheel 21 which will have teeth 22 in a number equal to the number of faces 19 on the indicator. This unit comprising an indicator and top wall is of a size so that its flanges 15 are slidable into the sleeve 11 where it is secured by means of allen screws 23 positioned through holes 24 in the sleeve 11 and into indentations 24' in the flanges 15 to hold it fixedly in position so that it will move with the sleeve as it is relatively reciprocated on the base.

The base unit 25 has a cylindrical portion 26 having a lateral flange 27. The cylindrical portion 26 slidably fits through the sleeve 11 as shown by dotted lines 28, while the flanges 27 engages the flange 12 at the lower end of the sleeve. The lower end of the cylindrical portion provides a base upon which the assembly rests. Upstanding from the flanged top 31 of the base unit 25 there are two pairs of pawls. Each pair has a pawl 32 with a blunt end as at 33, and a pawl 34 with a hooked end 35. One pair is for a ratchet on one side of indicator 18 while the other pair is for the ratchet on the other side thereof. A spring acts between the broader surface 31 of the base unit 25 and the undersurface of the top wall 13, this spring being shown as a compression spring 36 to move the sleeve 11 to which the top wall 13 is fixed and the base unit 25 in opposite directions.

Figure 4:
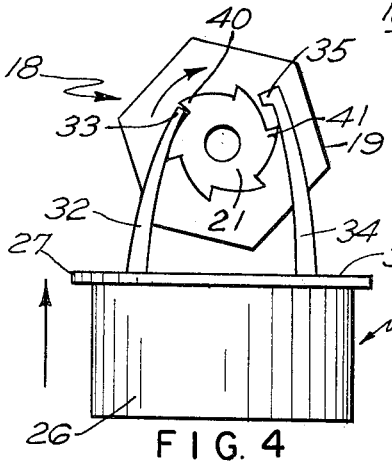
FIG. 4 is an elevation of the rotary indicator and its ratchet wheel relative to the pawl device in one position of the stroke.
Figure 5:
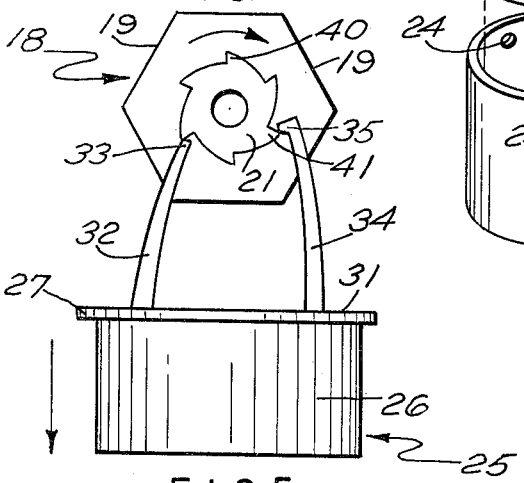
FIG. 5 is a view similar to FIG. 4 but showing the parts at the other limit of their stroke.

As shown in FIGS. 4 and 5, the blunt-ended pawl 32 has its blunt end 33 engaging the face of a pawl 40, while the pawl 34 has its hook end 35 engaging the face of the pawl 41. In FIG. 4 the sleeve with pawl unit 25 has been moved upwardly to its fullest extent which occurs when the base unit 25 is pressed upwardly in the sleeve 11 or the sleeve is moved downwardly, thus causing ratchet wheel 21 to have moved clockwise as seen in FIG. 4. When the sleeve is then moved in the opposite direction, the hook 35 will cause the ratchet wheel 21 to be moved in the direction of the arrow shown in FIG. 5 into the position shown in FIG. 5 which is the position of the parts as shown in FIG. 1 rotating the indicator clockwise as shown by the arrow in the figures. These parts are now in position so that when the sleeve is moved downwardly to the position shown in FIG. 2, the blunt end 33 of the pawl 32 comes into action and will move the ratchet wheel clockwise into a new position and bringing up another face 19 of the indicator with some other different insignia thereon. Thus, there is a portion of the rotary movement of the indicator occurring in each direction of the relative reciprocation of the parts 10 and 11, and a shorter relative movement is necessary to change from one face to another.

I claim:

1. A game device displaying a selected one of a plurality of insignia comprising a base includng means capable of independently supporting said game device on a surface during operation; and, a sleeve telescopically slidable relative to said base and located substantially above said base during operation of the game device, an indicator rotatably mounted on said sleeve, means comprising a part secured to said indicator and a part secured to said base to rotate said indicator a portion of a revolution upon relative reciprocation of said sleeve and base in each direction.

2. A game device as in claim 1 wherein said means comprises a ratchet wheel as one part and a pair of pawls as the other part, one of said pawls having a blunt end to engage a ratchet tooth when relatively moved in one direction and the other pawl has a hook to engage a ratchet tooth when moved in the other direction.

3. A game device as in claim 1 wherein a spring acts between said base and sleeve to relatively move said base and sleeve in one direction.

4. A game device as in claim 2 wherein there are pawl and ratchet means on opposite sides of the indicator.

* * * * *